US010777921B2

(12) United States Patent
Lu et al.

(10) Patent No.: US 10,777,921 B2
(45) Date of Patent: Sep. 15, 2020

(54) HIGH SPEED CARD EDGE CONNECTOR

(71) Applicant: Amphenol East Asia Ltd., Taoyuan (TW)

(72) Inventors: Lo-Wen Lu, Taoyuan (TW); Jong-Shiun Jiang, Taoyuan (TW); Chia-Te Huang, Taoyuan (TW)

(73) Assignee: Amphenol East Asia Ltd., Taoyuan (TW)

( * ) Notice: Subject to any disclaimer, the term of this patent is extended or adjusted under 35 U.S.C. 154(b) by 0 days.

(21) Appl. No.: 16/210,966

(22) Filed: Dec. 5, 2018

(65) Prior Publication Data

US 2019/0173209 A1 Jun. 6, 2019

(30) Foreign Application Priority Data

Dec. 6, 2017 (TW) ..... 106218121 U
Jan. 3, 2018 (TW) ..... 107200079 U

(51) Int. Cl.
*H01R 4/66* (2006.01)
*H01R 12/71* (2011.01)
(Continued)

(52) U.S. Cl.
CPC ..... *H01R 12/716* (2013.01); *H01R 12/00* (2013.01); *H01R 12/7005* (2013.01);
(Continued)

(58) Field of Classification Search
CPC ..... H01R 13/652
(Continued)

(56) References Cited

U.S. PATENT DOCUMENTS 2,996,710 A 8/1961 Pratt
3,002,162 A 9/1961 Garstang
(Continued)

FOREIGN PATENT DOCUMENTS

CN 1179448 C 12/2004
CN 1799290 A 7/2006
(Continued)

OTHER PUBLICATIONS

Extended European Search Report for European Application No. EP 11166820.8 dated Jan. 24, 2012.
(Continued)

*Primary Examiner* — Phuong K Dinh
(74) *Attorney, Agent, or Firm* — Wolf, Greenfield & Sacks, P.C.

(57) ABSTRACT

A compact, high performance electrical connector with a smooth insertion loss profile over a broad range of operating frequencies. The electrical connector has a mating interface with a slot that may receive a mating component, such as a paddle card of a plug connector. Rows of terminals line opposing sides of the slots. Terminals in each of the rows may be held together by an insulative seat body shaped to receive on side of a lossy member. The lossy member may have extension parts extending towards selected ones of the terminals in the rows that act as ground terminals, such that the lossy member is electrically coupled to the ground terminals and electrically isolated from the signal terminals. The connector, even though compact, may be easily assembly by first forming terminal subassemblies comprising two rows of terminals and lossy member, and then inserting the terminal subassemblies into an insulative body.

30 Claims, 11 Drawing Sheets

(51) Int. Cl.

| | |
|---|---|
| ***H01R 12/70*** | (2011.01) |
| ***H01R 12/82*** | (2011.01) |
| ***H01R 12/00*** | (2006.01) |
| ***H01R 13/6599*** | (2011.01) |
| ***H01R 12/73*** | (2011.01) |
| ***H01R 13/405*** | (2006.01) |

(52) U.S. Cl.
CPC ..... *H01R 12/73* (2013.01); *H01R 12/82* (2013.01); *H01R 13/405* (2013.01); *H01R 13/6599* (2013.01)

(58) Field of Classification Search
USPC ..... 439/108, 189
See application file for complete search history.

(56) References Cited

U.S. PATENT DOCUMENTS

| | | | |
|---|---|---|---|
| 3,134,950 | A | 5/1964 | Cook |
| 3,322,885 | A | 5/1967 | May et al. |
| 3,786,372 | A | 1/1974 | Epis et al. |
| 3,825,874 | A | 7/1974 | Peverill |
| 3,863,181 | A | 1/1975 | Glance et al. |
| 4,155,613 | A | 5/1979 | Brandeau |
| 4,195,272 | A | 3/1980 | Boutros |
| 4,276,523 | A | 6/1981 | Boutros et al. |
| 4,371,742 | A | 2/1983 | Manly |
| 4,408,255 | A | 10/1983 | Adkins |
| 4,447,105 | A | 5/1984 | Ruehl |
| 4,471,015 | A | 9/1984 | Ebneth et al. |
| 4,484,159 | A | 11/1984 | Whitley |
| 4,490,283 | A | 12/1984 | Kleiner |
| 4,518,651 | A | 5/1985 | Wolfe, Jr. |
| 4,519,664 | A | 5/1985 | Tillotson |
| 4,519,665 | A | 5/1985 | Althouse et al. |
| 4,632,476 | A | 12/1986 | Schell |
| 4,636,752 | A | 1/1987 | Saito |
| 4,682,129 | A | 7/1987 | Bakermans et al. |
| 4,751,479 | A | 6/1988 | Parr |
| 4,761,147 | A | 8/1988 | Gauthier |
| 4,806,107 | A | 2/1989 | Arnold et al. |
| 4,846,724 | A | 7/1989 | Sasaki et al. |
| 4,846,727 | A | 7/1989 | Glover et al. |
| 4,878,155 | A | 10/1989 | Conley |
| 4,948,922 | A | 8/1990 | Varadan et al. |
| 4,970,354 | A | 11/1990 | Iwasa et al. |
| 4,975,084 | A | 12/1990 | Fedder et al. |
| 4,992,060 | A | 2/1991 | Meyer |
| 5,000,700 | A | 3/1991 | Masubuchi et al. |
| 5,066,236 | A | 11/1991 | Broeksteeg |
| 5,141,454 | A | 8/1992 | Garrett et al. |
| 5,150,086 | A | 9/1992 | Ito |
| 5,166,527 | A | 11/1992 | Solymar |
| 5,168,252 | A | 12/1992 | Naito |
| 5,168,432 | A | 12/1992 | Murphy et al. |
| 5,176,538 | A | 1/1993 | Hansell, III et al. |
| 5,266,055 | A | 11/1993 | Naito et al. |
| 5,280,257 | A | 1/1994 | Cravens et al. |
| 5,287,076 | A | 2/1994 | Johnescu et al. |
| 5,334,050 | A | 8/1994 | Andrews |
| 5,340,334 | A | 8/1994 | Nguyen |
| 5,346,410 | A | 9/1994 | Moore, Jr. |
| 5,429,520 | A | 7/1995 | Morlion et al. |
| 5,429,521 | A | 7/1995 | Morlion et al. |
| 5,433,617 | A | 7/1995 | Morlion et al. |
| 5,433,618 | A | 7/1995 | Morlion et al. |
| 5,456,619 | A | 10/1995 | Belopolsky et al. |
| 5,461,392 | A | 10/1995 | Mott et al. |
| 5,474,472 | A | 12/1995 | Niwa et al. |
| 5,484,310 | A | 1/1996 | McNamara et al. |
| 5,496,183 | A | 3/1996 | Soes et al. |
| 5,499,935 | A | 3/1996 | Powell |
| 5,551,893 | A | 9/1996 | Johnson |
| 5,562,497 | A | 10/1996 | Yagi et al. |
| 5,597,328 | A | 1/1997 | Mouissie |
| 5,651,702 | A | 7/1997 | Hanning et al. |
| 5,669,789 | A | 9/1997 | Law |
| 5,796,323 | A | 8/1998 | Uchikoba et al. |
| 5,831,491 | A | 11/1998 | Buer et al. |
| 5,924,899 | A | 7/1999 | Paagman |
| 5,981,869 | A | 11/1999 | Kroger |
| 5,982,253 | A | 11/1999 | Perrin et al. |
| 6,019,616 | A | 2/2000 | Yagi et al. |
| 6,152,747 | A | 11/2000 | McNamara |
| 6,168,469 | B1 | 1/2001 | Lu |
| 6,174,203 | B1 | 1/2001 | Asao |
| 6,174,944 | B1 | 1/2001 | Chiba et al. |
| 6,217,372 | B1 | 4/2001 | Reed |
| 6,293,827 | B1 | 9/2001 | Stokoe |
| 6,296,496 | B1 | 10/2001 | Trammel |
| 6,299,438 | B1 | 10/2001 | Sahagian et al. |
| 6,299,483 | B1 | 10/2001 | Cohen et al. |
| 6,328,601 | B1 | 12/2001 | Yip et al. |
| 6,347,962 | B1 | 2/2002 | Kline |
| 6,350,134 | B1 | 2/2002 | Fogg et al. |
| 6,364,711 | B1 | 4/2002 | Berg et al. |
| 6,375,510 | B2 | 4/2002 | Asao |
| 6,379,188 | B1 | 4/2002 | Cohen et al. |
| 6,398,588 | B1 | 6/2002 | Bickford |
| 6,409,543 | B1 | 6/2002 | Astbury, Jr. et al. |
| 6,482,017 | B1 | 11/2002 | Van Doorn |
| 6,503,103 | B1 | 1/2003 | Cohen et al. |
| 6,506,076 | B2 | 1/2003 | Cohen et al. |
| 6,517,360 | B1 | 2/2003 | Cohen |
| 6,530,790 | B1 | 3/2003 | McNamara et al. |
| 6,537,087 | B2 | 3/2003 | McNamara et al. |
| 6,554,647 | B1 | 4/2003 | Cohen et al. |
| 6,565,387 | B2 | 5/2003 | Cohen |
| 6,579,116 | B2 | 6/2003 | Brennan et al. |
| 6,582,244 | B2 | 6/2003 | Fogg et al. |
| 6,595,802 | B1 | 7/2003 | Watanabe et al. |
| 6,602,095 | B2 | 8/2003 | Astbury, Jr. et al. |
| 6,616,864 | B1 | 9/2003 | Jiang et al. |
| 6,652,318 | B1 | 11/2003 | Winings et al. |
| 6,655,966 | B2 | 12/2003 | Rothermel et al. |
| 6,709,294 | B1 * | 3/2004 | Cohen ..... H01R 13/03 333/184 |
| 6,713,672 | B1 | 3/2004 | Stickney |
| 6,743,057 | B2 | 6/2004 | Davis et al. |
| 6,776,659 | B1 | 8/2004 | Stokoe et al. |
| 6,786,771 | B2 | 9/2004 | Gailus |
| 6,814,619 | B1 | 11/2004 | Stokoe et al. |
| 6,830,489 | B2 | 12/2004 | Aoyama |
| 6,872,085 | B1 | 3/2005 | Cohen et al. |
| 6,979,226 | B2 | 12/2005 | Otsu et al. |
| 7,044,794 | B2 | 5/2006 | Consoli et al. |
| 7,057,570 | B2 | 6/2006 | Irion, II et al. |
| 7,074,086 | B2 | 7/2006 | Cohen et al. |
| 7,094,102 | B2 | 8/2006 | Cohen et al. |
| 7,108,556 | B2 | 9/2006 | Cohen et al. |
| 7,163,421 | B1 | 1/2007 | Cohen et al. |
| 7,285,018 | B2 | 10/2007 | Kenny et al. |
| 7,335,063 | B2 | 2/2008 | Cohen et al. |
| 7,494,383 | B2 | 2/2009 | Cohen et al. |
| 7,540,781 | B2 | 6/2009 | Kenny et al. |
| 7,581,990 | B2 | 9/2009 | Kirk et al. |
| 7,588,464 | B2 | 9/2009 | Kim |
| 7,722,401 | B2 | 5/2010 | Kirk et al. |
| 7,731,537 | B2 | 6/2010 | Amleshi et al. |
| 7,753,731 | B2 | 7/2010 | Cohen et al. |
| 7,771,233 | B2 | 8/2010 | Gailus |
| 7,794,240 | B2 | 9/2010 | Cohen et al. |
| 7,794,278 | B2 | 9/2010 | Cohen et al. |
| 7,806,729 | B2 | 10/2010 | Nguyen et al. |
| 7,874,873 | B2 | 1/2011 | Do et al. |
| 7,887,371 | B2 | 2/2011 | Kenny et al. |
| 7,887,379 | B2 | 2/2011 | Kirk |
| 7,906,730 | B2 | 3/2011 | Atkinson et al. |
| 7,914,304 | B2 | 3/2011 | Cartier et al. |
| 7,985,097 | B2 | 7/2011 | Gulla |
| 8,083,553 | B2 | 12/2011 | Manter et al. |
| 8,182,289 | B2 | 5/2012 | Stokoe et al. |
| 8,215,968 | B2 | 7/2012 | Cartier et al. |
| 8,216,001 | B2 | 7/2012 | Kirk |

(56) References Cited

U.S. PATENT DOCUMENTS 8,272,877 B2 9/2012 Stokoe et al.
8,348,701 B1 1/2013 Lan et al.
8,371,875 B2 2/2013 Gailus
8,382,524 B2 2/2013 Khilchenko et al.
8,657,627 B2 2/2014 McNamara et al.
8,715,003 B2 5/2014 Buck et al.
8,771,016 B2 7/2014 Atkinson et al.
8,864,521 B2 10/2014 Atkinson et al.
8,926,377 B2 1/2015 Kirk et al.
8,944,831 B2 2/2015 Stoner et al.
8,998,642 B2 4/2015 Manter et al.
9,004,942 B2 4/2015 Paniagua
9,022,806 B2 5/2015 Cartier, Jr. et al.
9,028,281 B2 5/2015 Kirk et al.
9,124,009 B2 9/2015 Atkinson et al.
9,219,335 B2 12/2015 Atkinson et al.
9,225,085 B2 12/2015 Cartier, Jr. et al.
9,300,074 B2 3/2016 Gailus
9,450,344 B2 9/2016 Cartier, Jr. et al.
9,484,674 B2 11/2016 Cartier, Jr. et al.
9,509,101 B2 11/2016 Cartier, Jr. et al.
9,520,689 B2 12/2016 Cartier, Jr. et al.
9,742,132 B1 8/2017 Hsueh
9,972,945 B1 * 5/2018 Huang ..... H01R 13/6585
10,122,129 B2 11/2018 Milbrand, Jr. et al.
10,243,304 B2 3/2019 Kirk et al.
10,270,191 B1 4/2019 Li et al.
10,283,910 B1 * 5/2019 Chen ..... H01R 4/04
10,348,040 B2 7/2019 Cartier et al.
10,381,767 B1 8/2019 Milbrand, Jr. et al.
2001/0042632 A1 11/2001 Manov et al.
2002/0042223 A1 4/2002 Belopolsky et al.
2002/0089464 A1 7/2002 Joshi
2002/0098738 A1 7/2002 Astbury et al.
2002/0111068 A1 8/2002 Cohen et al.
2002/0111069 A1 8/2002 Astbury et al.
2004/0005815 A1 1/2004 Mizumura et al.
2004/0020674 A1 2/2004 McFadden et al.
2004/0115968 A1 6/2004 Cohen
2004/0121652 A1 6/2004 Gailus
2004/0196112 A1 10/2004 Welbon et al.
2004/0259419 A1 12/2004 Payne et al.
2005/0070160 A1 3/2005 Cohen et al.
2005/0133245 A1 6/2005 Katsuyama et al.
2005/0176835 A1 8/2005 Kobayashi et al.
2005/0233610 A1 10/2005 Tutt et al.
2005/0283974 A1 12/2005 Richard et al.
2005/0287869 A1 12/2005 Kenny et al.
2006/0068640 A1 3/2006 Gailus
2006/0255876 A1 11/2006 Kushta et al.
2007/0004282 A1 1/2007 Cohen et al.
2007/0021001 A1 1/2007 Laurx et al.
2007/0037419 A1 2/2007 Sparrowhawk
2007/0042639 A1 2/2007 Manter et al.
2007/0054554 A1 3/2007 Do et al.
2007/0059961 A1 3/2007 Cartier et al.
2007/0218765 A1 9/2007 Cohen et al.
2008/0194146 A1 8/2008 Gailus
2008/0246555 A1 10/2008 Kirk et al.
2008/0248658 A1 10/2008 Cohen et al.
2008/0248659 A1 10/2008 Cohen et al.
2008/0248660 A1 10/2008 Kirk et al.
2009/0011641 A1 1/2009 Cohen et al.
2009/0011645 A1 1/2009 Laurx et al.
2009/0035955 A1 2/2009 McNamara
2009/0061661 A1 3/2009 Shuey et al.
2009/0117386 A1 5/2009 Vacanti et al.
2009/0239395 A1 9/2009 Cohen et al.
2009/0258516 A1 10/2009 Hiew et al.
2009/0291593 A1 11/2009 Atkinson et al.
2009/0305530 A1 12/2009 Ito et al.
2009/0305533 A1 12/2009 Feldman et al.
2010/0048058 A1 2/2010 Morgan et al.
2010/0081302 A1 4/2010 Atkinson et al.
2010/0294530 A1 11/2010 Atkinson et al.
2011/0003509 A1 1/2011 Gailus
2011/0104948 A1 5/2011 Girard, Jr. et al.
2011/0143605 A1 6/2011 Pepe
2011/0212649 A1 9/2011 Stokoe et al.
2011/0212650 A1 9/2011 Amleshi et al.
2011/0230095 A1 9/2011 Atkinson et al.
2011/0230096 A1 9/2011 Atkinson et al.
2011/0256739 A1 10/2011 Toshiyuki et al.
2011/0287663 A1 11/2011 Gailus et al.
2012/0094536 A1 4/2012 Khilchenko et al.
2012/0156929 A1 6/2012 Manter et al.
2012/0184154 A1 7/2012 Frank et al.
2012/0202363 A1 8/2012 McNamara et al.
2012/0202386 A1 8/2012 McNamara et al.
2012/0214344 A1 8/2012 Cohen et al.
2013/0012038 A1 1/2013 Kirk et al.
2013/0017733 A1 1/2013 Kirk et al.
2013/0078870 A1 3/2013 Milbrand, Jr.
2013/0109232 A1 5/2013 Paniaqua
2013/0196553 A1 8/2013 Gailus
2013/0217263 A1 8/2013 Pan
2013/0225006 A1 8/2013 Khilchenko et al.
2013/0316590 A1 11/2013 Hon
2014/0004724 A1 1/2014 Cartier, Jr. et al.
2014/0004726 A1 1/2014 Cartier, Jr. et al.
2014/0004746 A1 1/2014 Cartier, Jr. et al.
2014/0057498 A1 2/2014 Cohen
2014/0273557 A1 9/2014 Cartier, Jr. et al.
2014/0273627 A1 9/2014 Cartier, Jr. et al.
2014/0377992 A1 12/2014 Chang et al.
2015/0056856 A1 2/2015 Atkinson et al.
2015/0111427 A1 4/2015 Foxconn
2015/0236451 A1 8/2015 Cartier, Jr. et al.
2015/0236452 A1 8/2015 Cartier, Jr. et al.
2015/0255926 A1 9/2015 Paniagua
2016/0149343 A1 5/2016 Atkinson et al.
2017/0352970 A1 12/2017 Liang et al.
2018/0062323 A1 3/2018 Kirk et al.
2018/0145438 A1 5/2018 Cohen
2018/0205177 A1 7/2018 Zhou et al.
2018/0212376 A1 7/2018 Wang et al.
2018/0219331 A1 8/2018 Cartier et al.
2018/0269607 A1 9/2018 Wu et al.
2019/0052019 A1 2/2019 Huang et al.
2019/0067854 A1 2/2019 Ju et al.
2019/0173232 A1 6/2019 Lu et al.

FOREIGN PATENT DOCUMENTS

CN 101176389 A 5/2008
CN 101600293 A 12/2009
CN 101790818 A 7/2010
CN 101120490 B 11/2010
CN 201846527 U 5/2011
CN 102239605 A 11/2011
CN 101600293 B 5/2012
CN 102598430 A 7/2012
CN 202395248 U 8/2012
CN 104409906 A 3/2015
CN 304240766 S 8/2017
CN 304245430 S 8/2017
CN 206712089 U 12/2017
CN 207677189 U 7/2018
DE 60216728 T2 11/2007
EP 1018784 A1 7/2000
EP 1779472 A1 5/2007
EP 2169770 A2 3/2010
EP 2405537 A1 1/2012
GB 1272347 A 4/1972
JP 07302649 A 11/1995
JP 2001-510627 A 7/2001
JP 2006-344524 A 12/2006
MX 9907324 A1 8/2000
TW M558481 U 4/2018
TW M558482 U 4/2018
TW M558483 U 4/2018
TW M559006 U 4/2018
TW M559007 U 4/2018
TW M560138 U 5/2018

(56) References Cited

FOREIGN PATENT DOCUMENTS

| | | | |
|---|---|---|---|
| TW | M562507 | U | 6/2018 |
| TW | M565894 | Y | 8/2018 |
| TW | M565895 | Y | 8/2018 |
| TW | M565899 | Y | 8/2018 |
| TW | M565900 | Y | 8/2018 |
| TW | M565901 | Y | 8/2018 |
| WO | WO 88/05218 | A1 | 7/1988 |
| WO | WO 98/35409 | A1 | 8/1998 |
| WO | WO 2004/059794 | A2 | 7/2004 |
| WO | WO 2004/059801 | A1 | 7/2004 |
| WO | WO 2006/039277 | A1 | 4/2006 |
| WO | WO 2007/00597 | A2 | 1/2007 |
| WO | WO 2007/005599 | A1 | 1/2007 |
| WO | WO 2008/124057 | A1 | 10/2008 |
| WO | WO 2010/030622 | A1 | 3/2010 |
| WO | WO 2010/039188 | A1 | 4/2010 |
| WO | WO 2017/007429 | A1 | 1/2017 |

OTHER PUBLICATIONS

International Search Report and Written Opinion for International Application No. PCT/CN2017/108344 dated Aug. 1, 2018.
International Search Report and Written Opinion for International Application No. PCT/US2010/056482 dated Mar. 14, 2011.
International Preliminary Report on Patentability for International Application No. PCT/US2010/056482 dated May 24, 2012.
International Search Report and Written Opinion for International Application No. PCT/US2011/026139 dated Nov. 22, 2011.
International Preliminary Report on Patentability for International Application No. PCT/US2011/026139 dated Sep. 7, 2012.
International Search Report and Written Opinion for International Application No. PCT/US2012/023689 dated Sep. 12, 2012.
International Preliminary Report on Patentability for International Application No. PCT/US2012/023689 dated Aug. 15, 2013.
International Search Report and Written Opinion for International Application No. PCT/US2012/060610 dated Mar. 29, 2013.
International Search Report and Written Opinion for International Application No. PCT/US2015/012463 dated May 13, 2015.
International Search Report and Written Opinion for International Application No. PCT/US2017/047905 dated Dec. 4, 2017.
International Search Report with Written Opinion for International Application No. PCT/US2006/025562 dated Oct. 31, 2007.
International Search Report and Written Opinion for International Application No. PCT/US2005/034605 dated Jan. 26, 2006.
International Search Report and Written Opinion for International Application No. PCT/US2011/034747 dated Jul. 28, 2011.
[No Author Listed], Carbon Nanotubes for Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.
Beaman, High Performance Mainframe Computer Cables. 1997 Electronic Components and Technology Conference. 1997;911-7.
Shi et al, Improving Signal Integrity in Circuit Boards by Incorporating Absorbing Materials. 2001 Proceedings. 51st Electronic Components and Technology Conference, Orlando FL. 2001:1451-56.

* cited by examiner

HIGH SPEED CARD EDGE CONNECTOR

CROSS-REFERENCE TO RELATED APPLICATIONS

This application claims priority to and the benefit of Taiwanese Patent Application Serial No. 107200079, filed Jan. 3, 2018, entitled "CONNECTOR WITH CONDUCTIVE PLASTIC MEMBERS", as well as Taiwanese Patent Application Serial No. 106218121, filed Dec. 6, 2017, entitled "CONNECTOR WITH CONDUCTIVE PLASTIC MEMBERS ARRANGED IN INSULATION BODY." The entire contents of these applications are incorporated herein by reference in their entirety.

BACKGROUND

This disclosure relates generally to electrical interconnection systems and more specifically to compact electrical connectors.

Electrical connectors are used in many electronic systems. In general, various electronic devices (such as smart phones, tablet computers, desktop computers, notebook computers and digital cameras) have been provided with various types of connectors so that the electronic devices can exchange data with each other. Therefore, it can be seen that the connectors can be used for electrical connection and signal transmission between devices, between components and between systems, and are basic components needed to make a complete system.

It is generally easier and more cost effective to manufacture a system as separate electronic assemblies, such as printed circuit boards ("PCBs"), which may be joined together with electrical connectors. In some scenarios, the PCBs to be joined each have connectors mounted to them, which may be mated to directly interconnect the PCBs.

In other scenarios, the PCB's are connected through a cable. Connectors may nonetheless be used to make such connections. The cable may be terminated at least at one end with a plug connector. A PCB may be equipped with a receptacle connector into which the plug connector can be inserted, making connections between the PCB and the cable. A similar arrangement may be used at the other end of the cable, connecting the cable to another PCB, so that signals may pass between the printed circuit boards through the cable.

BRIEF SUMMARY

According to one aspect of the present application, an electrical connector is provided, comprising a first insulative body. The first insulative body may comprise an accommodation space therein so as to provide a mating interface at a front side of the insulative body, and a terminal subassembly disposed within the insulative body. The terminal subassembly may comprise a second insulative body, a plurality of signal terminals fixed to the second insulative body with front ends thereof exposed within the accommodation space and rear ends passing through the second insulative body and extending from a rear end of the first insulative body, and a plurality of grounding terminals fixed to the second insulative body with front ends thereof exposed within the accommodation space and rear ends passing through the second insulative body and extending from the rear end of the first insulative body. The terminal subassembly may be provided with at least one conductive plastic member. The conductive plastic member may comprise extension parts extending towards the plurality of grounding terminals, and body portions between the extension parts set back from the plurality of signal terminals.

In some embodiments, the second insulative body may be a first seat body. The terminal subassembly may comprise the first seat body and a second seat body. One side of the first seat body may be recessed with a first assembly space. A corresponding side of the second seat body may be recessed with a second assembly space. The at least one conductive plastic member may be disposed between the first assembly space and the second assembly space.

In some embodiments, the plurality of extension parts may each extend in a protruding manner towards a corresponding grounding terminal of the plurality of grounding terminals and contact the corresponding grounding terminal.

In some embodiments, the plurality of signal terminals and the plurality of grounding terminals may be held by the first seat body and the second seat body.

In some embodiments, the first assembly space of the first seat body and the second assembly space of the second seat body may conform to the at least one conductive plastic member.

In some embodiments, the conductive plastic member may be insert molded in at least one of the first assembly space of the first seat body or the second assembly space of the second seat body.

In some embodiments, the at least one conductive plastic member may be inserted in and engaged with the first seat body and the second seat body.

In some embodiments, the at least one conductive plastic member may comprise a first conductive plastic member at least partially disposed within the first assembly space, and a second conductive plastic member at least partially disposed in the second assembly space, such that each of the first and second conductive plastic members therein contact one another between the first seat body and the second seat body.

In some embodiments, the electrical connector may further comprise a metal casing, the first insulative body being disposed in the metal casing.

In some embodiments, the plurality of signal terminals and the plurality of grounding terminals may each extend in a mating direction. Sides of the at least one conductive plastic member that are parallel to the mating direction may be entirely contained within the first or second insulative body.

In some embodiments, the first seat body may be positioned opposite the second seat body along a first direction. Sides of the at least one conductive plastic member that face in or opposite the first direction may be entirely contained within the terminal subassembly.

In some embodiments, all sides of the at least one conductive plastic member may be contained within the terminal subassembly.

In some embodiments, a first group of the plurality of extension parts of the at least one conductive plastic member may extend towards the first seat body. A second group of the plurality of extension parts of the at least one conductive plastic member may extend towards the second seat body. The first assembly space of the first seat body may comprise a plurality of openings each shaped to receive an extension part of the first group of the plurality of extension parts. The second assembly space of the second seat body may comprise a plurality of openings each shaped to receive an extension part of the second group of the plurality of extension parts.

In some embodiments, the at least one conductive plastic member may comprise a binder and a plurality of conductive particles held within the binder.

In some embodiments, the at least one conductive plastic member may comprise a plastic member comprising a plurality of surfaces and a coating of conductive material on at least a portion of the plurality of surfaces.

In some embodiments, the at least one conductive plastic member may have a bulk conductivity of between 10 Siemens/meter and about 200 Siemens/meter.

According to one aspect of the present application, an electrical connector is provided, comprising a first insulative body comprising an accommodation space therein so as to provide a mating interface at a front side of the first insulative body, a first terminal subassembly disposed within the first insulative body, and a second terminal subassembly disposed within the first insulative body. The first terminal subassembly may comprise a second insulative body, a plurality of signal terminals fixed to the second insulative body with front ends thereof exposed within the accommodation space, and rear ends passing through the second insulative body and extending from a rear end of the first insulative body, and a plurality of grounding terminals fixed to the second insulative body with front ends thereof exposed within the accommodation space and rear ends passing through the second insulative body and extending from the rear end of the first insulative body. The second terminal assembly may comprise at least one conductive plastic member comprising a portion of the first terminal subassembly with at least a portion thereof exposed outside the first terminal subassembly. The at least one conductive plastic member may comprise extension parts extending towards the plurality of grounding terminals and body portions between the extension parts set back from the plurality of signal terminals.

In some embodiments, the second insulative body may be a first seat body. The first terminal subassembly may comprise the first seat body and a second seat body. One side of the first seat body may be recessed with a first assembly space. A corresponding side of the second seat body may be recessed with a second assembly space. The at least one conductive plastic member may be disposed between the first assembly space and the second assembly space.

In some embodiments, the plurality of extension parts may extend in a protruding manner towards a corresponding grounding terminal of the plurality of grounding terminals and contact the corresponding grounding terminal.

In some embodiments, the first terminal subassembly may conform to the plurality of signal terminals and the plurality of grounding terminals.

In some embodiments, the first assembly space of the first seat body and the second assembly space of the second seat body may conform to the at least one conductive plastic member.

In some embodiments, the at least one conductive plastic member may be insert molded in at least one of the first assembly space of the first seat body or the second assembly space of the second seat body.

In some embodiments, the at least one conductive plastic member may be inserted in and engaged with the first seat body and the second seat body.

In some embodiments, the at least one conductive plastic member may comprise a first conductive plastic member disposed in the first assembly space and a second conductive plastic member disposed in the second assembly space such that the first and second conductive plastic members contact one another between the first seat body and the second seat body.

In some embodiments, the electrical connector may further comprise a metal casing, the insulative body being disposed in the metal casing.

In some embodiments, the insulative body may conform to the first terminal subassembly.

In some embodiments, the plurality of signal terminals and the plurality of grounding terminals may extend in a mating direction. A side of the at least one conductive plastic member facing opposite the mating direction may be entirely exposed outside the terminal subassembly.

In some embodiments, a first group of the plurality of extension parts of the at least one conductive plastic member may extend towards the first seat body. A second group of the plurality of extension parts of the at least one conductive plastic member may extend towards the second seat body. The first assembly space of the first seat body may comprise a plurality of openings each shaped to receive an extension part of the first group of the plurality of extension parts. The second assembly space of the second seat body may comprise a plurality of openings each shaped to receive an extension part of the second group of the plurality of extension parts.

In some embodiments, the at least one conductive plastic member may comprise a binder and a plurality of conductive particles held within the binder.

In some embodiments, the at least one conductive plastic member may comprise a plastic member comprising a plurality of surfaces and a coating of conductive material on at least a portion of the plurality of surfaces.

In some embodiments, the at least one conductive plastic member may have a bulk conductivity of between 10 Siemens/meter and about 200 Siemens/meter.

According to one aspect of the present application, an electrical connector is provided, comprising an insulative housing, a first row, a second row, and a lossy member. The insulative housing may comprise a back and a front with a slot. The slot may comprise a first side and second side. The first row may comprise a first plurality of terminals comprising signal terminals and ground terminals, the first plurality of terminals disposed along the first side of the slot. The second row may comprise a second plurality of terminals comprising signal terminals and ground terminals, the second plurality of terminals disposed along the second of the slot. The lossy member may comprise a plurality of extension portions and body portions therebetween. The extension portions may be electrically coupled to the ground terminals of the first plurality of terminals and the second plurality of terminals. The body portions of the lossy member may be aligned with and electrically isolated from the signal terminals. The body portions of the lossy member may be positioned between the slot and the back.

In some embodiments, the first plurality of terminals may be disposed in a repeating pattern of ground terminal, signal terminal, signal terminal.

According to one aspect of the present application, a method of manufacturing an electrical connector is provided. The method may comprise forming a terminal subassembly by molding a first seat body over a first row of terminals, the first seat body comprising at least one first assembly space adjacent a portion of the terminals in first row, molding a second seat body over a second row of terminals, the second seat body comprising at least one second assembly space adjacent a portion of the terminals in second row, positioning a lossy member between the first seat body and the second seat body with extension portions within the at least one first assembly space and the at least one second assembly space, and inserting the terminal subassembly into a cavity of a housing comprising a slot configured to receive a mating component, with the first row of terminals aligned with a first side of the slot and the second row of terminals aligned with a second side of the slot.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
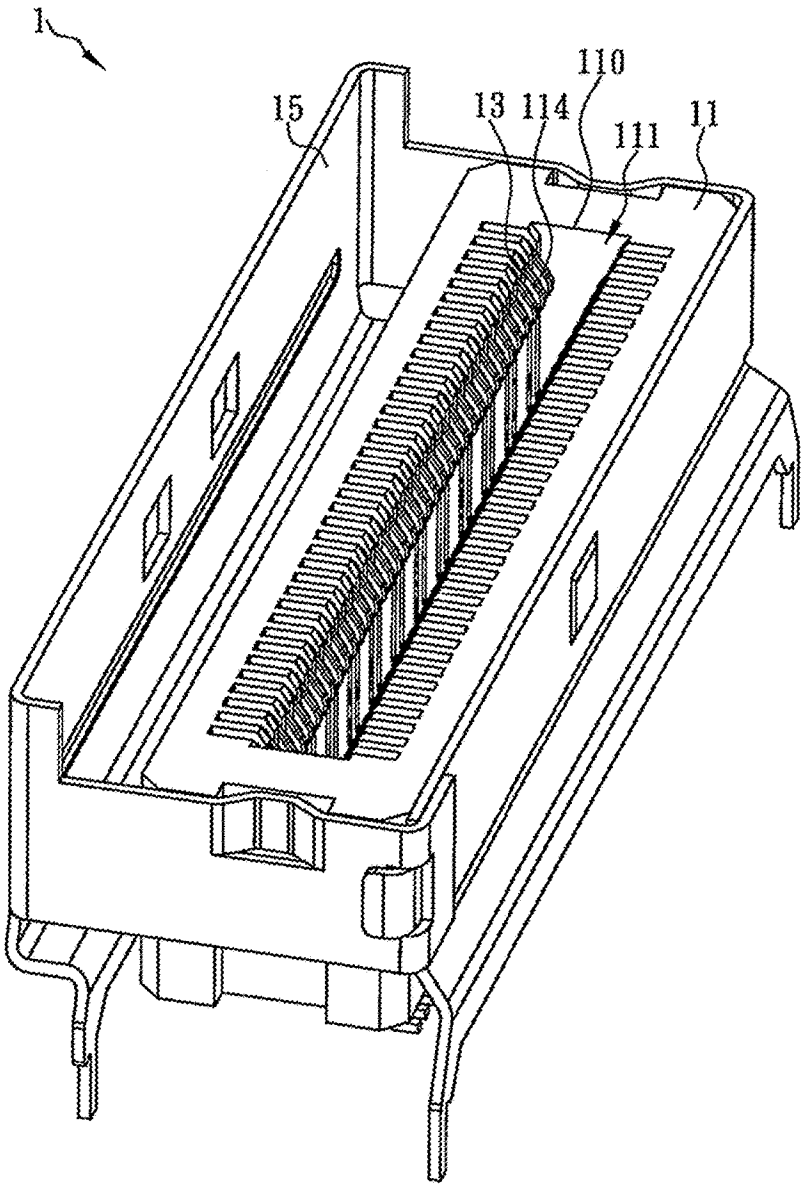
FIG. 1 is a schematic perspective view of a connector according to a first embodiment.

The inventors have recognized various challenges in producing electrical connectors, such as mated plug and receptacle connectors, with low insertion loss to pass signals between PCBs while occupying a small volume. Low insertion loss is desirable in that it facilitates signals traveling the full path between interconnected PCBs without significant impact on signal integrity. However, it is a challenge to design a connector that provides low insertion loss while meeting other requirements, such as occupying a small volume. For example, a connector having a small volume may have signal terminal pairs positioned in a high density configuration, which may cause high levels of cross-talk between adjacent signal terminal pairs. The high levels of cross-talk between adjacent signal terminal pairs may result in loss of signal energy to the adjacent signal terminal pairs. Additionally, insertion loss may be increased due to exciting undesired electromagnetic propagation modes in the connector.

To overcome these challenges, the inventors have developed an electrical connector including at least one conductive plastic member inside or on an insulative body of the connector which facilitate the connector having desirable electrical properties while also having a small volume. For example, the connector may include first and second sets of signal and ground terminals separated by one or more conductive plastic members, with the one or more conductive plastic members electrically coupled to the ground terminals. The one or more conductive plastic members may facilitate low insertion loss in the connector, for example by damping cross-talk signals between adjacent terminal pairs, and by damping undesired electromagnetic propagation modes, thus reducing resonances within the operating frequency range of the connector and reducing leakage of signal energy into adjacent signal pairs or such undesired modes. The one or more conductive members may be at least partially lossy in order to adequately increase signal integrity, but may not dissipate a substantial amount of signal energy, preserving low insertion loss in the connector. Thus, conductive plastic members may be included in a connector to achieve desirable electrical properties in the connector.

An additional challenge is manufacturing an electrical connector having a small volume with a high degree of precision and without damaging the connector. Connectors are often manufactured at high volume in an automated process having a limited degree of precision and applying forces which may damage small parts if not properly aligned.

Accordingly, the inventors have developed an electrical connector having one or more conductive plastic members which is more easily manufactured by providing specialized conductive plastic members configured for inserting within an electrical connector. For example, terminal subassemblies (e.g. for supporting signal and grounding terminals of the connector) may comprise spaces for receiving parts of the conductive plastic members. Accordingly, when the conductive plastic members are inserted into or mounted onto an insulative body of the connector, the conductive plastic members may be easily positioned and combined with the terminal subassemblies to align with and contact grounding terminals of the connector.

According to a first embodiment, a connector is provided with at least one conductive plastic member arranged in an insulative body, the connector comprising an insulative body, a terminal subassembly, with a plurality of signal terminals, a plurality of grounding terminals. The insulative body may have a mating interface at a front side thereof. The mating interface may include an accommodation space into which a mating component may be inserted. The terminal subassembly may include an insulative seat body. Signal terminals and grounding terminals may be held by the insulative seat body in the terminal subassembly. The terminal subassembly may be inserted into a cavity in the insulative body so as to assemble a connector 1. When assembled, front ends of the signal terminals and the grounding terminals will be exposed in the accommodation space for contacting terminals of the mating component. The mating component, for example, may be a paddle card of a plug connector or a printed circuit board of other configuration. Rear ends of the signal terminals and the grounding terminals may pass through the terminal subassembly and extend from a rear end of the insulative body. The conductive plastic members can be arranged in the terminal subassembly, and can extend towards the grounding terminals while being insulated from the signal terminals, such that the connector can have a more stable performance during high-frequency and high-speed transmission.

In some embodiments, the terminal subassembly is assembled from a first seat body and a second seat body. Sides of the seat bodies facing each other are respectively recessed with an assembly space, so that the conductive plastic members can be accommodated in the assembly space, and thus, the conductive plastic members can more be conveniently inserted in the terminal subassembly, enabling the connector to be assembled with or without the conductive plastic members.

In some embodiments, the conductive plastic members are provided with a plurality of extension parts, with each of the extension parts extending towards the corresponding grounding terminal. The extension parts may be electrically coupled to the grounding terminals, such as by physically contact or with such a small separation that there is capacitive coupling. The body of the conductive plastic member may be separated, by at least the length of the extension parts, from the signal terminals such that the occurrence of a short circuit, caused by the signal terminals inadvertently touching the conductive plastic members, can be prevented.

According to a second embodiment a connector is provided with at least one conductive plastic member, the connector comprising an insulative body, a first terminal subassembly including a plurality of signal terminals and a plurality of grounding terminals, and a second terminal subassembly. Either or both of the terminal subassemblies may include a conductive plastic member(s). Components of the connector of the second embodiment may be similar to corresponding components of the connector of the first embodiment, with the first terminal subassembly of the second embodiment corresponding to the terminal subassembly of the first embodiment. The second terminal subassembly can include the conductive plastic member(s) attached to the first terminal subassembly, with at least a partial region thereof exposed outside the first terminal subassembly. The conductive plastic member(s) can extend towards the grounding terminals while being insulated from the signal terminals, so that the connector can have a more stable performance during high-frequency and high-speed transmission.

Figure 2:
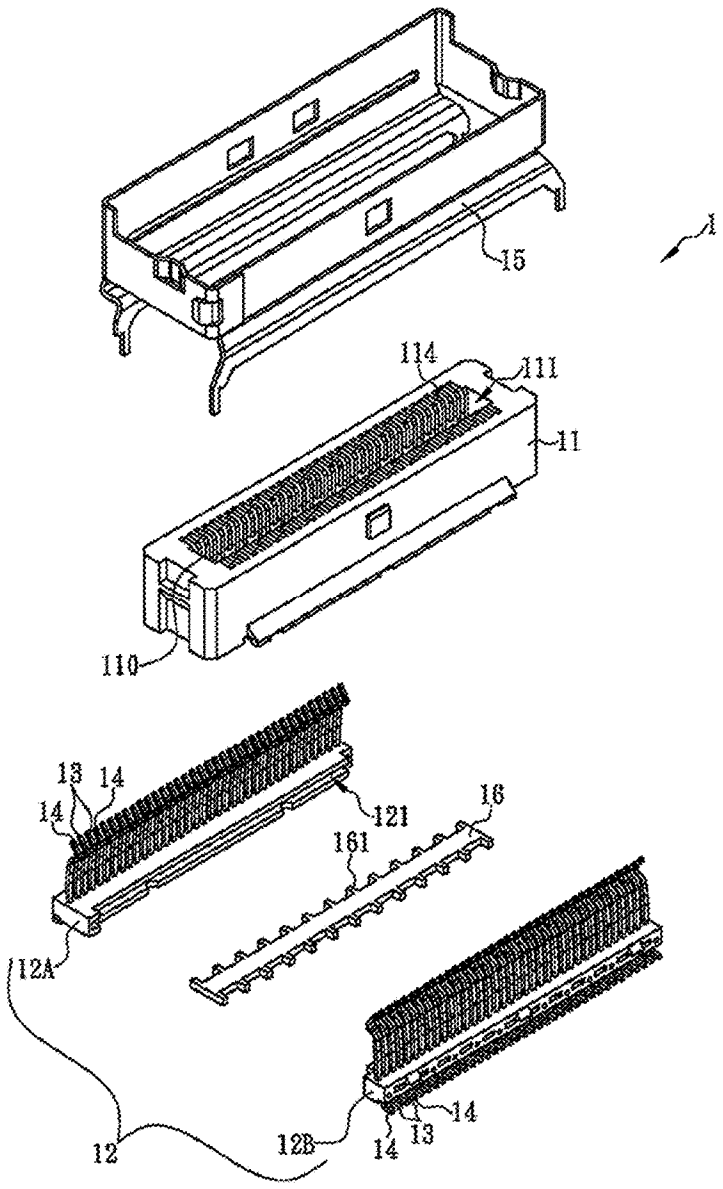
FIG. 2 is an exploded schematic view of the connector according to the first embodiment.

FIGS. 1 and 2 illustrate an electrical connector according to a first embodiment with at least one conductive plastic member arranged in an insulative body. An electrical connector 1 comprises an insulative body 11, a terminal subassembly 12, a plurality of signal terminals 13, a plurality of grounding terminals 14, a metal casing 15, and at least one conductive plastic member 16. For convenience of explanation, an upper side of FIG. 1 is referred to as a front side location of an assembly, and a lower side of FIG. 1 is referred to as a back side location of the assembly. The front side is adapted to mate with another connector and the back side is adapted for mounting to a printed circuit board.

Conductive plastic member 16 (as well as at least one conductive plastic member 26 described in connection with FIG. 6) is an example of an electrically lossy member. An electrically lossy member may be molded from or include a lossy plastic material. Plastic materials that conduct, but with some loss, or plastic materials that absorb electromagnetic energy over the frequency range of interest are referred to herein generally as "lossy" materials. Electrically lossy material can be formed from plastic or other dielectric materials, such as those that have an electric loss tangent greater than approximately 0.05 in the frequency range of interest. The "electric loss tangent" is the ratio of the imaginary part to the real part of the complex electrical permittivity of the material. Electrically lossy materials can also be formed from materials that are generally thought of as conductors, but are either relatively poor conductors over the frequency range of interest, contain conductive particles or regions that are sufficiently dispersed that they do not provide high conductivity or otherwise are prepared with properties that lead to a relatively weak bulk conductivity compared to a good conductor such as copper over the frequency range of interest.

Electrically lossy materials typically have a bulk conductivity of about 1 Siemen/meter to about 100,000 Siemens/meter and preferably about 1 Siemen/meter to about 10,000 Siemens/meter. In some embodiments material with a bulk conductivity of between about 10 Siemens/meter and about 200 Siemens/meter may be used. As a specific example, material with a conductivity of about 50 Siemens/meter may be used. However, it should be appreciated that the conductivity of the material may be selected empirically or through electrical simulation using known simulation tools to determine a suitable conductivity that provides both a suitably low crosstalk with a suitably low signal path attenuation or insertion loss.

Electrically lossy materials may be partially conductive materials, such as those that have a surface resistivity between 1 Ω/square and 100,000 Ω/square. In some embodiments, the electrically lossy material has a surface resistivity between 10 Ω/square and 1000 Ω/square. As a specific example, the material may have a surface resistivity of between about 20 Ω/square and 80 Ω/square.

In some embodiments, electrically lossy material is formed by adding to a binder a filler that contains conductive particles. In such an embodiment, a lossy member may be formed by molding or otherwise shaping the binder with filler into a desired form. Examples of conductive particles that may be used as a filler to form an electrically lossy material include carbon or graphite formed as fibers, flakes, nanoparticles, or other types of particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. The binder or matrix may be any material that will set, cure, or can otherwise be used to position the filler material. In some embodiments, the binder may be a thermoplastic material traditionally used in the manufacture of electrical connectors to facilitate the molding of the electrically lossy material into the desired shapes and locations as part of the manufacture of the electrical connector. Examples of such materials include liquid crystal polymer (LCP) and nylon. However, many alternative forms of binder materials may be used. Curable materials, such as epoxies, may serve as a binder. Alternatively, materials such as thermosetting resins or adhesives may be used. Use of such materials enables the lossy material to be molded into a desired shape.

Also, while the above described binder materials may be used to create an electrically lossy material by forming a binder around conducting particle fillers, the application is not so limited. For example, conducting particles may be impregnated into a formed matrix material or may be coated onto a formed matrix material, such as by applying a conductive coating to a plastic component or a metal component. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Celanese Corporation which can be filled with carbon fibers or stainless steel filaments. A lossy material, such as lossy conductive carbon filled adhesive preform, such as those sold by Techfilm of Billerica, Mass., US may also be used. This preform can include an epoxy binder filled with carbon fibers and/or other carbon particles. The binder surrounds carbon particles, which act as a reinforcement for the preform. Such a preform may be inserted in a connector to form a conductive plastic member. In some embodiments, the preform may adhere through the adhesive in the preform, which may be cured in a heat treating process. In some embodiments, the adhesive may take the form of a separate conductive or non-conductive adhesive layer. In some embodiments, the adhesive in the preform alternatively or additionally may be used to secure one or more conductive elements, such as foil strips, to the lossy material.

Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

In some embodiments, a conductive plastic member may be manufactured by stamping a preform or sheet of lossy plastic material. For example, an insert may be formed by stamping a preform as described above with an appropriate pattern of openings. However, other materials may be used instead of or in addition to such a preform. A sheet of ferromagnetic material, for example, may be used.

However, conductive plastic members also may be formed in other ways. In some embodiments, a conductive plastic member may be formed by interleaving layers of lossy and conductive material such as metal foil. These layers may be rigidly attached to one another, such as through the use of epoxy or other adhesive, or may be held together in any other suitable way. The layers may be of the desired shape before being secured to one another or may be stamped or otherwise shaped after they are held together.

Referring to FIGS. 1 and 2, in the first embodiment, the metal casing 15 is formed by bending a metal plate. Where the metal plate is bent into a frame shape, a space running through front and rear sides will be enclosed by the frame. The insulative body 11 can extend into the space and be fixed in metal casing 15. In this configuration, the metal casing 15 may prevent electromagnetic interference (EMI), serve as a grounding route, and/or protect the insulative body 11. The metal casing 15 may also form a portion of the latching structure that latches a plug connector to connector 1. Snap fit holes may be provided in side walls of the metal casing 15.

The insulative body 11 may have a mating interface 110 at a front side thereof and an accommodation space 111 therein. The mating interface 110 includes an accommodation space 111. In the embodiment, two inner sides of accommodation space 111, bounded by the insulative body 11 may include a plurality of terminal slots 114 that open into the accommodation space 111. However, in some embodiments, the insulative body 11 may not include the terminal slots 114.

With reference to FIGS. 1 and 2 again, the terminal subassembly 12 is made with insulative portions and can be inserted into the insulative body 11. The signal terminals 13 and the grounding terminals 14 are respectively fixed to the terminal subassembly 12 and are spaced apart from each other. The signal terminals 13 and the corresponding grounding terminals 14 can be respectively embedded in the terminal slots 114. The front ends of signal terminals 13 and the grounding terminals 14 may be exposed in the accommodation space 111 (as shown in FIG. 1), so that when another connector (not shown in the figure) is inserted into the connector 1, terminals of the other connector can extend into the accommodation space 111 and be electrically connected to the front ends of the corresponding signal terminals 13 and grounding terminals 14. The rear ends of the signal terminals 13 and the grounding terminals 14 will pass through the terminal subassembly 12 and extend from a rear end of the insulative body 11 (as shown in FIG. 1) so that they can be attached to a circuit board (not shown in the figure), such as by soldering.

Figure 3:
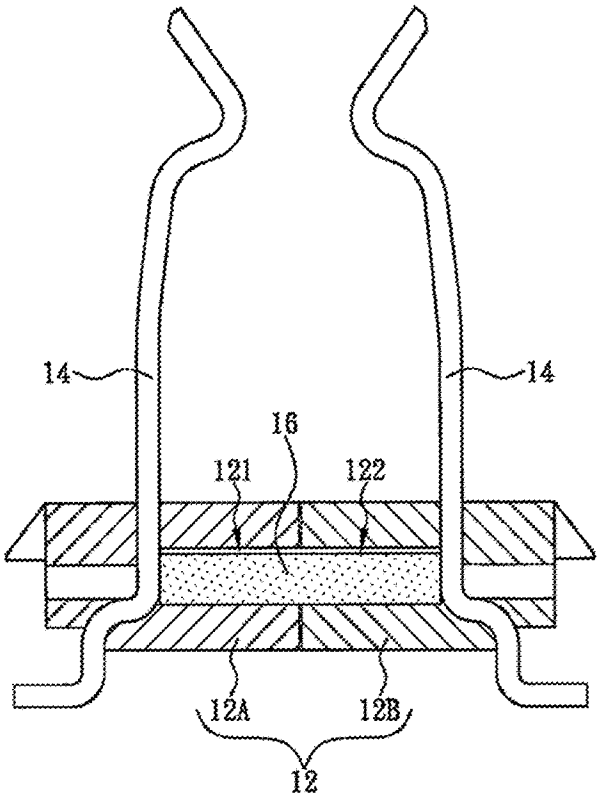
FIG. 3 is a partial cross-sectional schematic view of a terminal subassembly, signal terminals, grounding terminals and conductive plastic members according to a first embodiment.

In the embodiment, with reference to FIGS. 2 and 3, the terminal subassembly 12 has a first seat body 12A and a second seat body 12B, each holding a row of terminals. The signal terminals 13 and the grounding terminals 14 can be respectively disposed on a first seat body 12A and a second seat body 12B. In the embodiment illustrated, two adjacent signal terminals 13 are arranged between two grounding terminals 14 according to actual requirements of the connector 1, but the connector is not limited to such a terminal configuration. In some embodiments, the ground terminals may be structurally different than the signal terminals, such as by having portions that are wider than corresponding portions of the signal terminals. In other embodiments, the signal and ground terminals may have the same structure, but may be differentiated by position within a row, with pairs of terminals being signal pairs and adjacent terminals being ground terminals so as to create a repeating pattern of terminals, such as Ground-Signal-Signal. Alternatively or additionally ground terminals and signal terminals may be differentiated by manner of mounting in a terminal subassembly, such as by proximity to a lossy member or configuration of insulative material adjacent to the terminal.

One side of the first seat body 12A may be recessed with a first assembly space 121, and a corresponding side of the second seat body 12B may be recessed with a second assembly space 122. The conductive plastic member(s) 16 can be accommodated between the first assembly space 121 and the second assembly space 122, such that when the first seat body 12A is integrated with the second seat body 12B, the conductive plastic member(s) 16 can be fixed in the terminal subassembly 12. However, in accordance with other embodiments, the terminal subassembly 12 can include a single insulative seat body or three or more seat bodies according to production or design requirements.

Additionally, in the embodiment, with reference to FIG. 2, the first seat body 12A and the second seat body 12B can be molded onto the signal terminals 13 and the grounding terminals 14 in an injection molding manner. In addition, because the first seat body 12A and the second seat body 12B have the same style, the first seat body 12A and the second seat body 12B can be manufactured using the same set of molds, so as to save the production cost.

Figure 4:
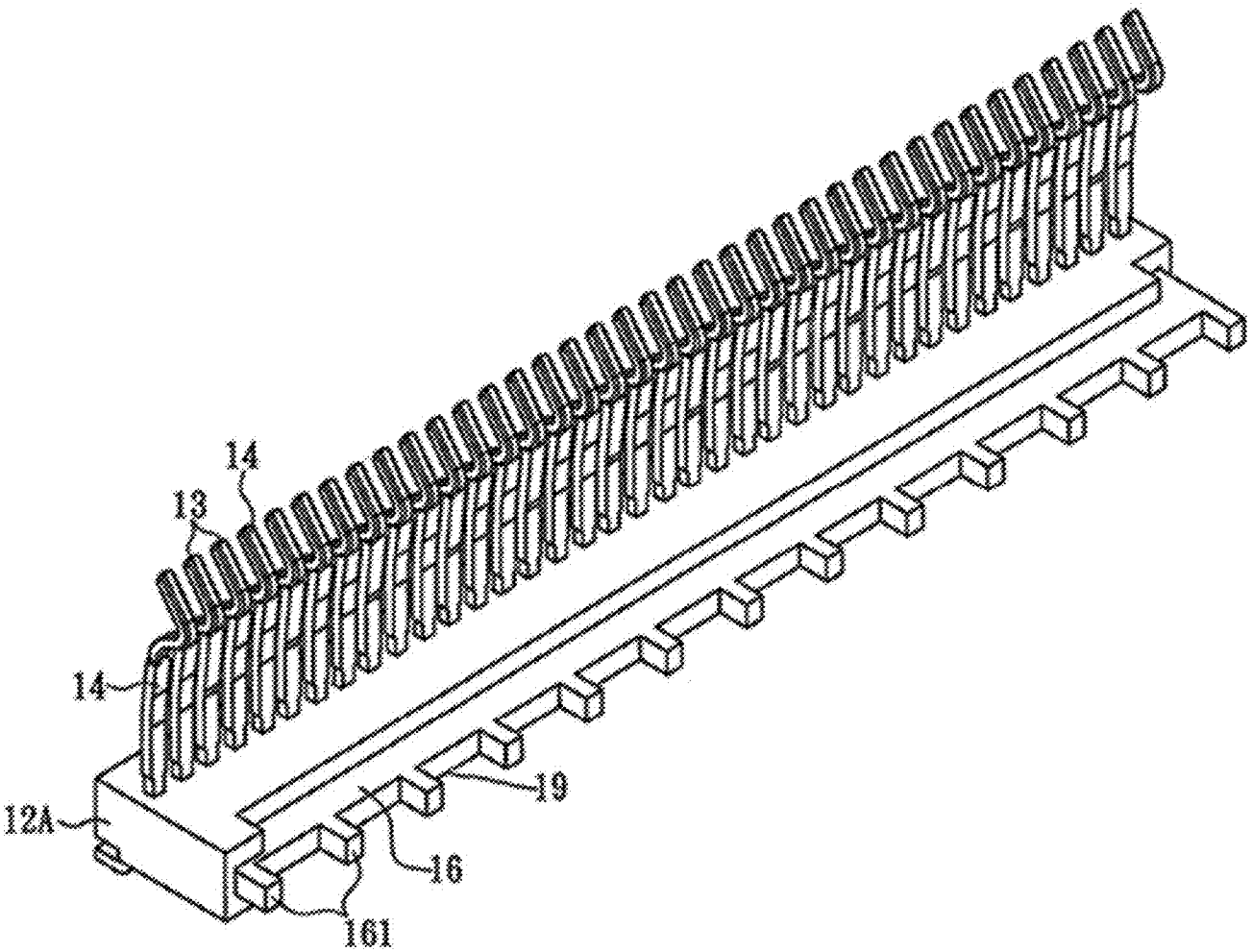
FIG. 4 is a perspective view of the terminal subassembly, the signal terminals, the grounding terminals and the conductive plastic members according to the first embodiment.

The conductive plastic member(s) 16 may be fixed onto the terminal subassembly 12 in the following manners:

(1) the conductive plastic member(s) 16 can be first molded in the first assembly space 121 of the first seat body 12A in an injection molding manner, and then portions of the conductive plastic member(s) 16 beyond the first assembly space 121 (as shown in FIG. 4) can be assembled into the second assembly space 122 of the second seat body 12B;

(2) the conductive plastic member(s) 16 can be separate assemblies, and the separate conductive plastic member(s) 16 can be engaged into the corresponding assembly spaces 121 and 122 of the first seat body 12A and the second seat body 12B by means of a machine or in a manual manner; or (3) Multiple conductive plastic members 16 can be respectively molded in the corresponding assembly spaces 121 and 122 of the first seat body 12A and the second seat body 12B (e.g., two conductive plastic members 16) in an injection molding manner, and then, the first seat body 12A may be combined with the second seat body 12B so that the conductive plastic members 16 contact one another between the first seat body 12A and the second seat body 12B.

Figure 5:
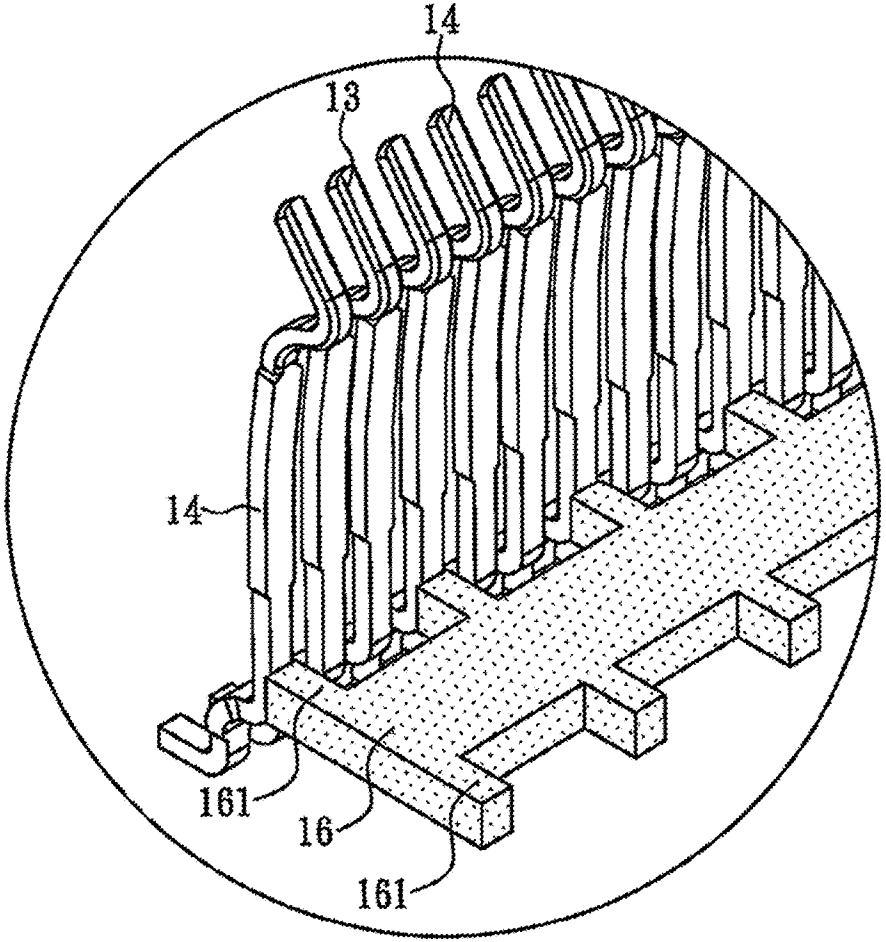
FIG. 5 is a perspective view of the signal terminals, the grounding terminals and the conductive plastic members according to the first embodiment.

Referring to FIGS. 2, 3 and 5, in the first embodiment, the conductive plastic member(s) 16 include a plurality of extension parts 161 each extending in a protruding manner, toward the direction of a corresponding ground terminal 14 and couples to the grounding terminals 14 (as shown in FIGS. 3 and 5) while being insulated from the signal terminals 13, so as to avoid a short circuit condition. As can be seen, the conductive plastic member 16 includes body portions 19 between the extension parts 161 separated from the signal terminals 13 by at least the length of the extension parts 161, so as to provide very little coupling between signal terminals 13 and conductive plastic member 16. In contrast, the extension parts 161 extend towards ground terminals 14, so as to physically contact them or to be so close to them that they are electrically coupled to them via capacitive coupling.

Figure 6:
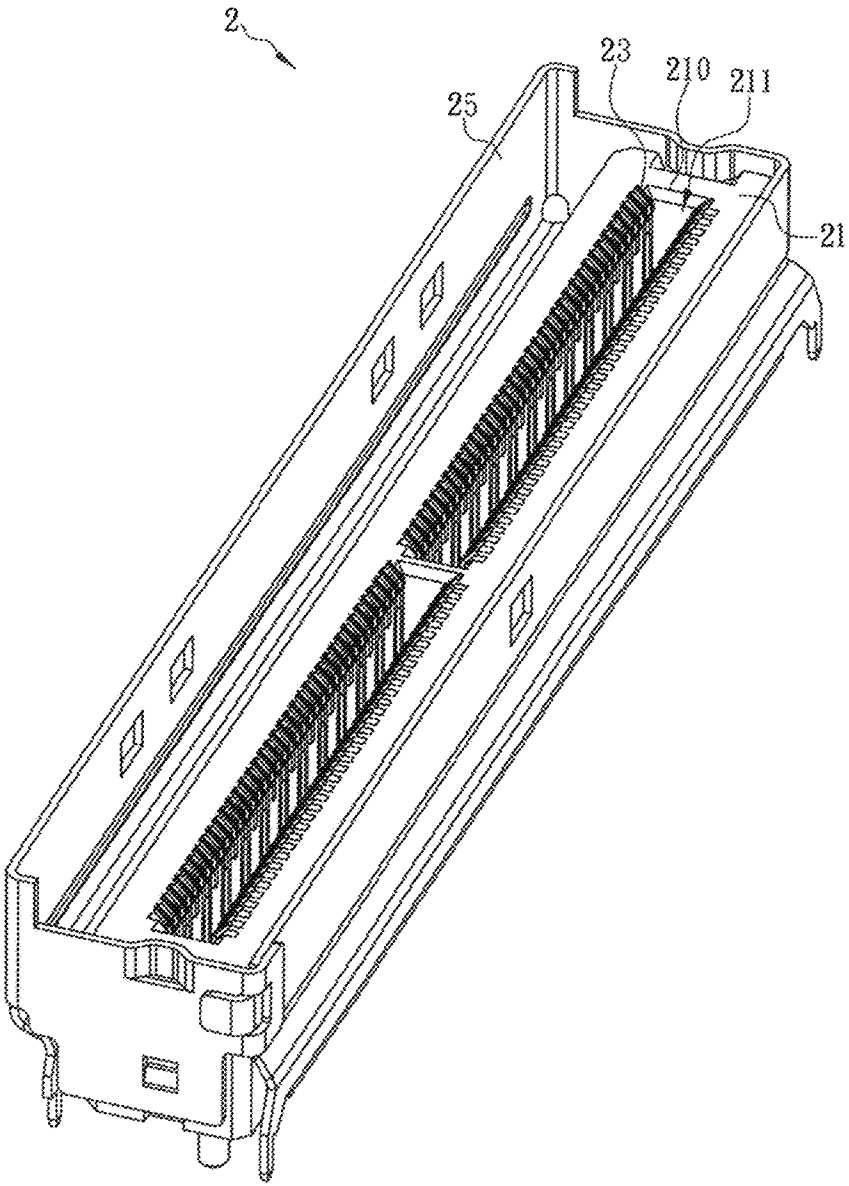
FIG. 6 is a schematic perspective view of a connector according to a second embodiment.
Figure 7:
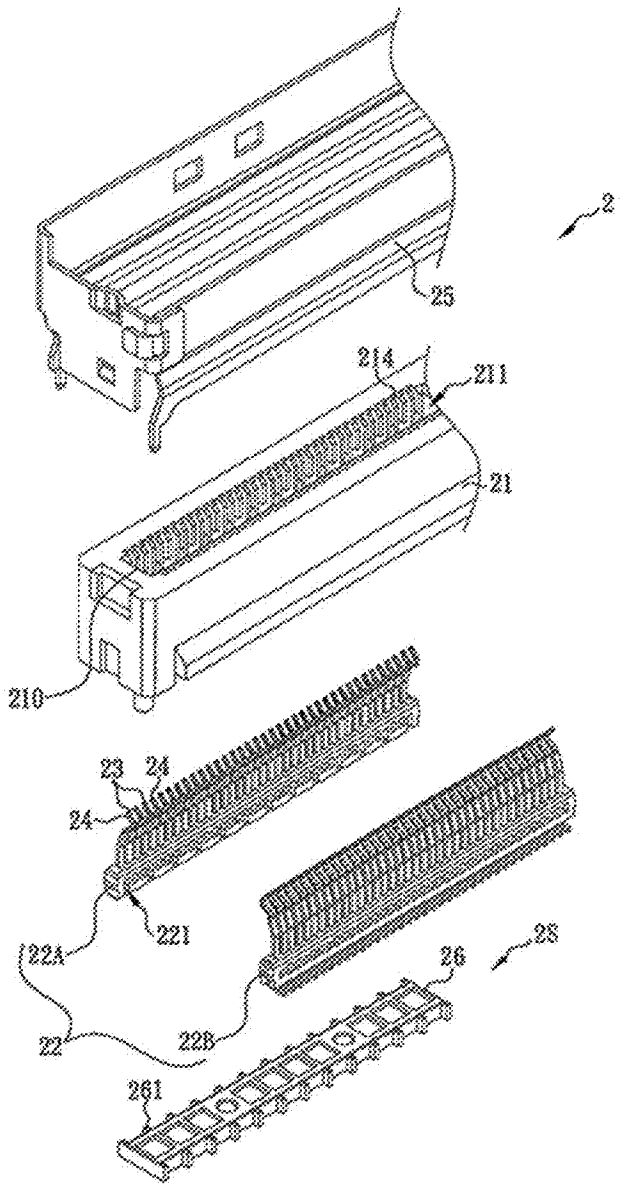
FIG. 7 is an exploded schematic view of the connector according to the second embodiment.

FIGS. 6 and 7 illustrate an electrical connector 2 according to a second embodiment with at least one conductive plastic member. The electrical connector 2 comprises an insulative body 21, a first terminal subassembly 22 including a plurality of signal terminals 23 and a plurality of grounding terminals 24, a second terminal subassembly 28 including at least one conductive plastic member 26, and a metal casing 25. For convenience of explanation, an upper side of FIG. 6 is used as a front side location of an assembly, and a lower side of FIG. 6 is used as a back side location of the assembly.

Referring to FIGS. 6 and 7, in the second embodiment, the insulative body 21 and metal casing 25 may be similar to as described in the first embodiment so as to include a mating interface 210 at a front side thereof and an accommodation space 211 therein, with the accommodation space 211 and the mating interface 210 in communication with each other. In the second embodiment, two inner sides corresponding to the insulative body 21 are respectively provided with a plurality of terminal slots 214, and the mating interface 210 and the terminal slots 214 are also in communication with the accommodation space 211. In some embodiments, the insulative body 21 can also be provided without the terminal slots 214.

With reference to FIGS. 6 and 7 again, the first terminal subassembly 22 is similar to the terminal assembly 12 of the first embodiment. In the second embodiment, with reference to FIGS. 7 and 8, the first terminal subassembly 22 is assembled by a first seat body 22A and a second seat body 22B, and the signal terminals 23 and the grounding terminals 24 can be respectively disposed on a first seat body 22A and a second seat body 22B, and two adjacent signal terminals 23 can be arranged between two grounding terminals 24 according to actual requirements of the connector 2, but not limited thereto.

One side of the first seat body 22A may be recessed with a first assembly space 221, and a corresponding side of the second seat body 22B may be recessed with a second assembly space 222. The conductive plastic member(s) 26 can be accommodated between the first assembly space 221 and the second assembly space 222, such that a side of the conductive plastic member(s) 26 can be exposed outside the first terminal assembly 22, and thus, when the first seat body 22A is integrated with the second seat body 22B, the conductive plastic member(s) 26 can be fixed with the first terminal subassembly 22. However, in some embodiments, the first terminal subassembly 22 can be composed of a single assembly or more than three assemblies. Both the first terminal subassembly 22 and the insulative body 21 can be integrally molded to shorten the production process, while maintaining the described relationship among the signal terminals 23, the grounding terminals 24, and the conductive plastic member(s) 26 with respect to the insulative body 21.

Figure 9:
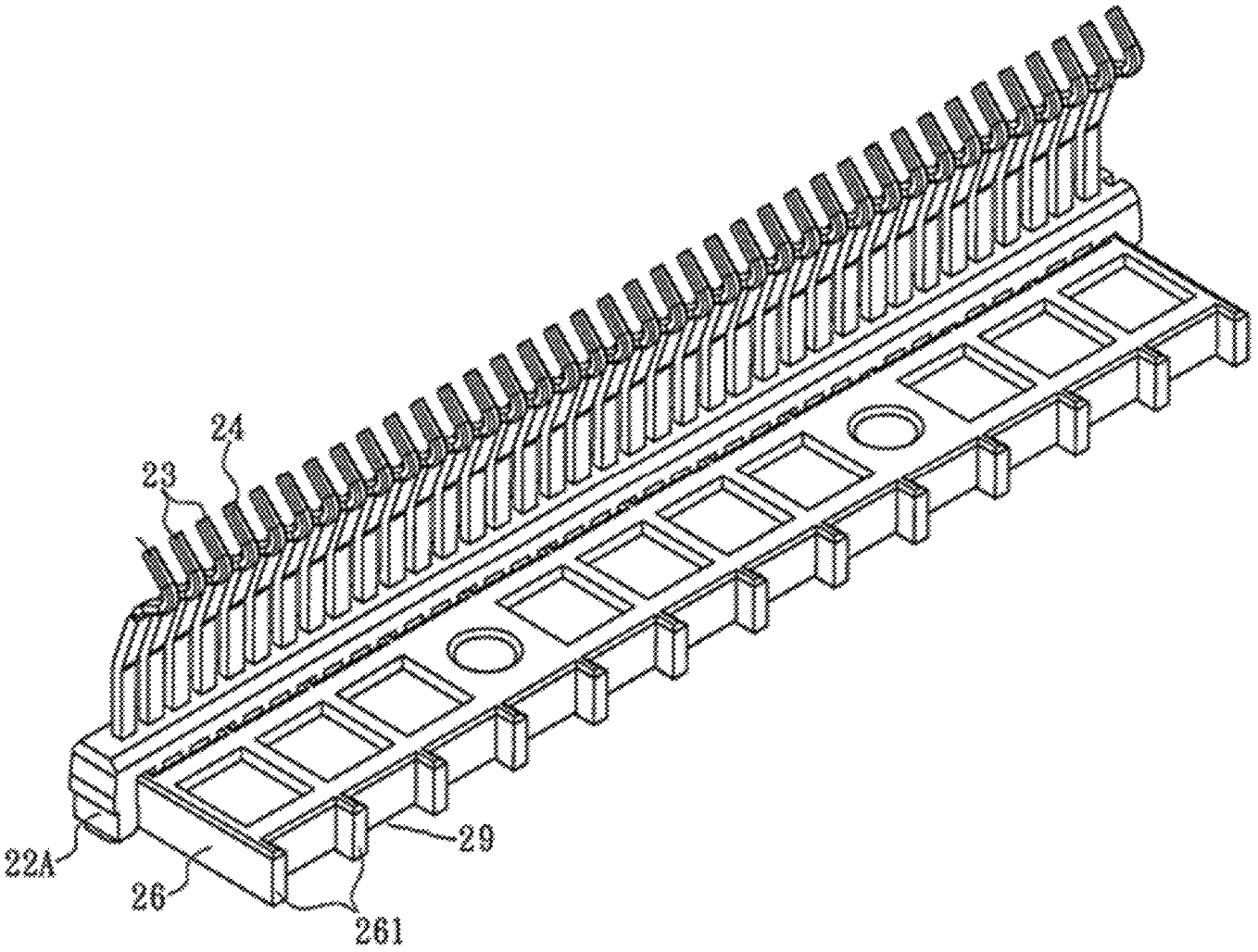
FIG. 9 is a perspective view of the terminal subassembly, the signal terminals, the grounding terminals and the conductive plastic members according to the second embodiment.

Additionally, in the embodiment, with reference to FIG. 7, the first seat body 22A and the second seat body 22B can be molded onto the signal terminals 23 and the grounding terminals 24 in an injection molding manner. In addition, since the first seat body 22A and the second seat body 22B have the same style, the first seat body 22A and the second seat body 22B can be manufactured using the same set of molds, so as to save the production cost. The conductive plastic member(s) 26 may be fixed onto the first terminal subassembly 22 in the following manners:

(1) the conductive plastic member(s) 26 can be first molded in the first assembly space 221 of the first seat body 22A in an injection molding manner, and then portions of the conductive plastic member(s) 26 beyond the first assembly space 221 (as shown in FIG. 9) can be entirely or partially assembled into the second assembly space 222 of the second seat body 22B;

(2) the conductive plastic members 26 can be separate assemblies, and the conductive plastic members 26 can be engaged into the corresponding assembly spaces 221 and 222 of the first seat body 22A and the second seat body 22B by means of a machine or in a manual manner; or (3) multiple conductive plastic members 26 can be respectively molded in the corresponding assembly spaces 221 and 222 of the first seat body 22A and the second seat body 22B (e.g., two conductive plastic members 26) in an injection molding manner, and then, the first seat body 22A may be combined with the second seat body 22B so that the conductive plastic members 26 in the first seat body 22A and the second seat body 22B can abut against one another integrally.

Figure 8:
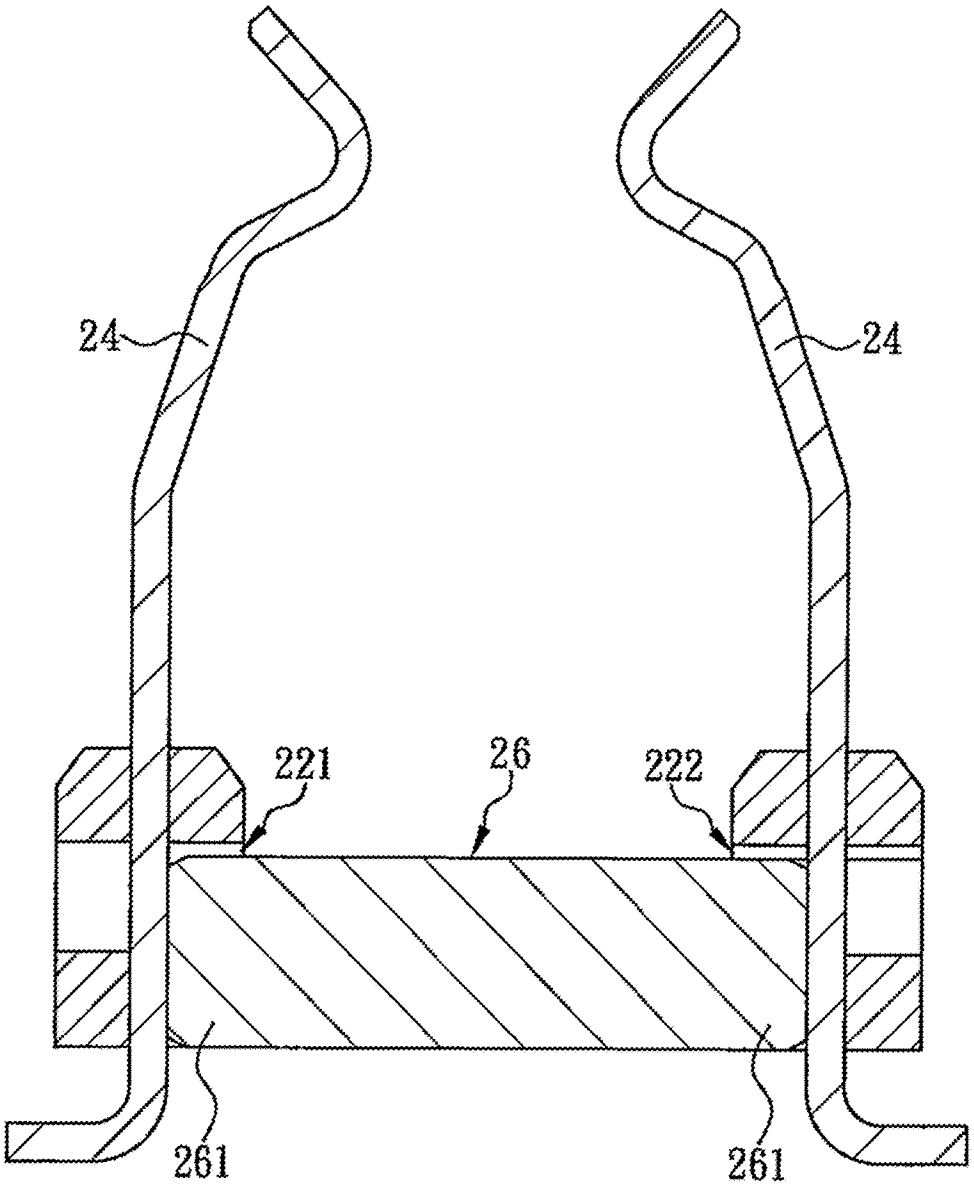
FIG. 8 is a partial cross-sectional schematic view of a terminal subassembly, signal terminals, grounding terminals and conductive plastic members according to a second embodiment.
Figure 10:
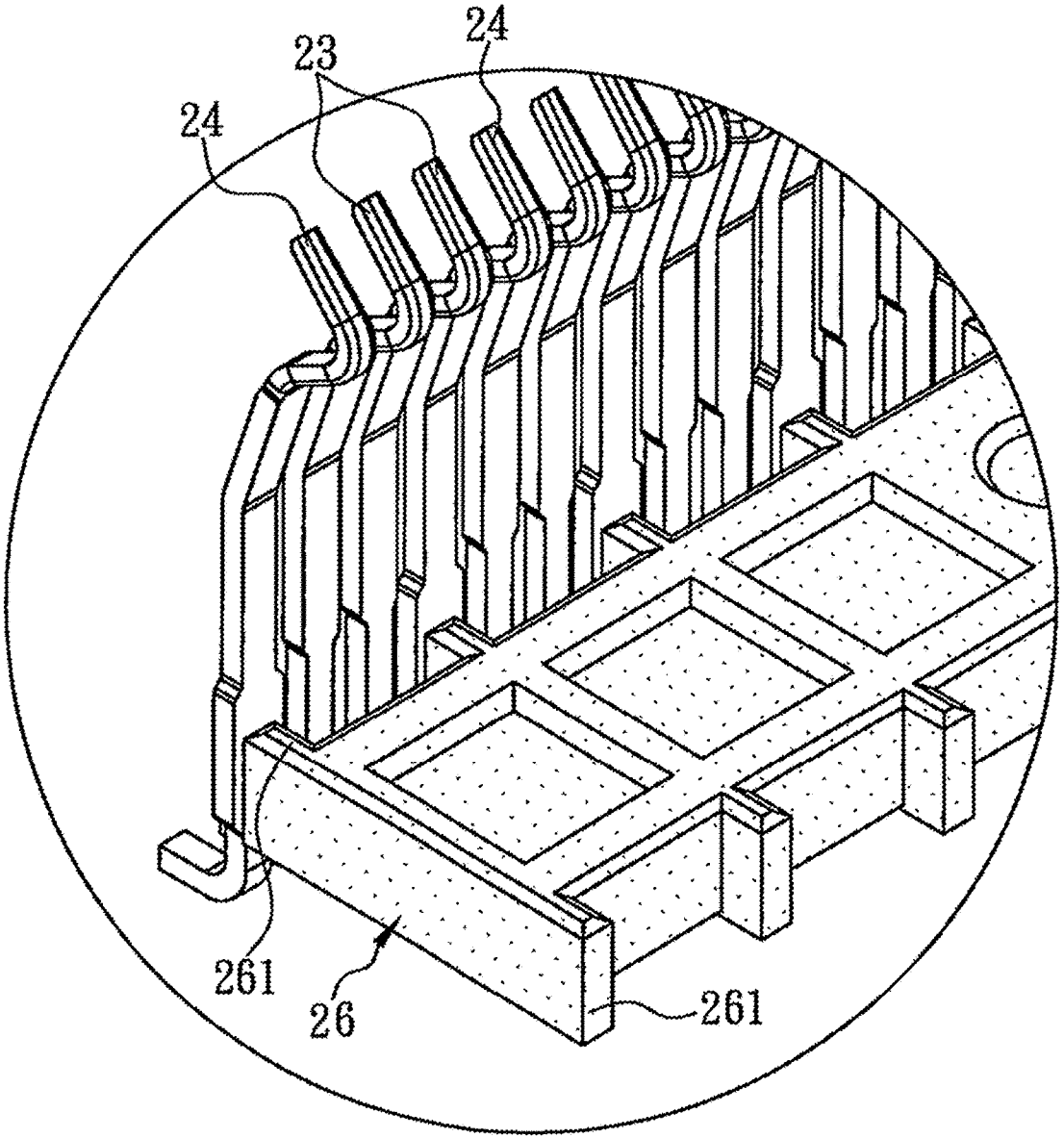
FIG. 10 is a perspective view of the signal terminals, the grounding terminals and the conductive plastic members according to the second embodiment.

With reference to FIGS. 7, 8 and 10, in the second embodiment, the periphery of the conductive plastic member(s) 26 is provided with a plurality of extension parts 261 in a protruding manner, and each of the extension parts 261 extends toward the direction of the corresponding ground terminal 24 and only abuts against each of the grounding terminals 24 (as shown in FIGS. 8 and 10) without touching each of the signal terminals 23, so as to avoid a short circuit condition. As can be seen, the body of the conductive plastic member(s) 26 between the extension parts 261 are separated from the signal terminals 23 by at least the length of the extension parts 261, so as to provide very small coupling between signal terminals 23 and conductive plastic member(s) 26. In contrast, the extension parts 261 are positioned to abut ground terminals 24, so as to physically contact them or to be so close to them that they are electrically coupled to them via capacitive coupling.

Referring to FIG. 10, the ground terminals may be structurally different than the signal terminals, such as by having portions that are wider than corresponding portions of the signal terminals. For example, portions of the grounding terminals 24 adjacent the extension parts 261 of the conductive plastic member(s) 26 may be substantially wider than portions of the signal terminals 23 adjacent body portions 29 of the conductive plastic member(s). The portions of the grounding terminals 24 may be wider than other portions of the grounding terminals 24. The portions of the signal terminals 23 may be substantially narrower than other portions of the signal terminals 23.

In other embodiments, the signal and ground terminals may have the same structure, but may be differentiated by position within a row, with pairs of terminals being signal pairs and adjacent terminals being ground terminals so as to create a repeating pattern of terminals, such as Ground-Signal-Signal. Alternatively or additionally ground terminals and signal terminals may be differentiated by manner of mounting in a terminal subassembly, such as by proximity to a lossy member or configuration of insulative material adjacent to the terminal.

Figure 11:
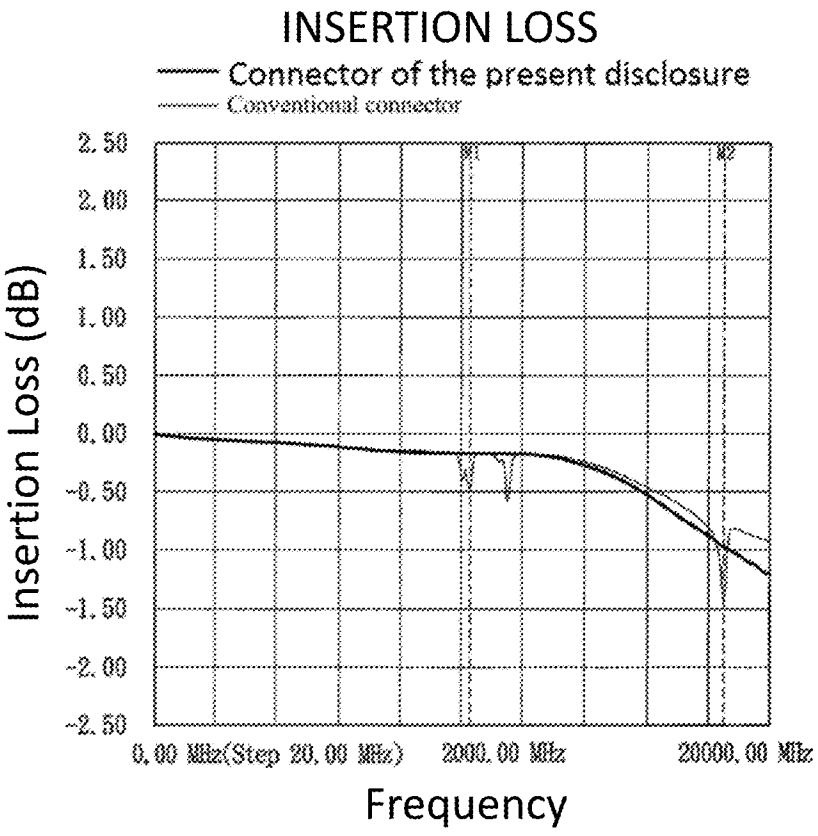
FIG. 11 is a test result of the connectors according to various embodiments of the present disclosure and a conventional connector.

FIG. 11, shows comparative insertion loss for the connector 1 or 2 and a conventional connector (e.g., without conductive plastic members). As can be seen in the figure, at frequencies of M1 and M2, transmission of signals through the conventional connector is not ideal, with an increase in insertion loss that interfere with signal propagation. By providing conductive plastic member(s) 26 as described herein, the connector 1 or 2 avoids such increases in insertion loss at frequencies over the operating frequency range of the connector. As a result, the connector has a more stable performance during high-frequency and high-speed transmission as compared with the conventional connector (e.g., without conductive plastic members), so as to meet the user requirements of a user. The overall volume of the connector 1 or 2 has not been excessively increased, as the conductive plastic member may be integrated into insulative body of the connector without requiring additional space in a direction perpendicular to the slot forming the accommodation space.

Having thus described several aspects various embodiments, it is to be appreciated that various alterations, modifications, and improvements will readily occur to those skilled in the art.

For example, instead of or in addition to lossy materials formed of conductors in a binder, materials that are electrically lossy because they absorb magnetic energy may be used in some embodiments.

For example, the structure of the conductive plastic members 16 and/or 26 may vary according to the actual shape of the terminal subassembly 12 or 22. Therefore, the conductive plastic members 16 and 26 may differ from as illustrated in FIGS. 5 and 10. The conductive plastic members 26 may still be located in the terminal subassembly 12 or 22, and at least a partial region thereof may be exposed outside the terminal subassembly 12 or 22, and may contact the grounding terminals 14 or 24 and not contact the signal terminals 13 or 23.

For example, the number of terminal subassemblies may be greater or less than as described herein.

For example, connectors 1 and 2 may not include the metal casing 15 or 25, or the metal casing 15 or 25 may be integrated with an outer casing or another mechanism of a product. Such structures equivalent to the metal casing 15 or 25 may be included.

Such alterations, modifications, and improvements are intended to be part of this disclosure, and are intended to be within the spirit and scope of the present disclosure. Further, though advantages of the present disclosure are indicated, it should be appreciated that not every embodiment will include every described advantage. Some embodiments may not implement any features described as advantageous herein and in some instances. Accordingly, the foregoing description and drawings are by way of example only.

Various aspects of the present disclosure may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, aspects of the present disclosure may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. An electrical connector, comprising:

a first insulative body, comprising an accommodation space therein so as to provide a mating interface at a front side of the insulative body;

a terminal subassembly disposed within the first insulative body, the terminal subassembly comprising:

a second insulative body and a third insulative body, wherein one side of the second insulative body is recessed with a first assembly space and a corresponding side of the third insulative body is recessed with a second assembly space;

a plurality of signal terminals fixed to the second insulative body with front ends thereof exposed within the accommodation space and rear ends passing through the second insulative body and extending from a rear end of the first insulative body; and a plurality of grounding terminals fixed to the second insulative body with front ends thereof exposed within the accommodation space and rear ends passing through the second insulative body and extending from the rear end of the first insulative body;

wherein:

the terminal subassembly is provided with at least one conductive plastic member;

the at least one conductive plastic member comprises extension parts extending towards the plurality of grounding terminals and body portions between the extension parts set back from the plurality of signal terminals; and the at least one conductive plastic member is disposed between the first assembly space and the second assembly space.

2. The electrical connector of claim 1, wherein the plurality of extension parts each extend in a protruding manner towards a corresponding grounding terminal of the plurality of grounding terminals and contact the corresponding grounding terminal.

3. The electrical connector of claim 2, wherein the plurality of signal terminals and the plurality of grounding terminals are held by the second insulative body and the third insulative body.

4. The electrical connector of claim 3, wherein the first assembly space of the second insulative body and the second assembly space of the third insulative body conform to the at least one conductive plastic member.

5. The electrical connector of claim 3, wherein the at least one conductive plastic member is insert molded in at least one of the first assembly space of the second insulative body or the second assembly space of the third insulative body.

6. The electrical connector of claim 3, wherein the at least one conductive plastic member is inserted in and engaged with the second insulative body and the third insulative body.

7. The electrical connector of claim 3, wherein the at least one conductive plastic member comprises a first conductive plastic member at least partially disposed within the first assembly space, and a second conductive plastic member at least partially disposed in the second assembly space, such that each of the first and second conductive plastic members therein contact one another between the second insulative body and the third insulative body.

8. The electrical connector of claim 1, further comprising a metal casing, the first insulative body being disposed in the metal casing.

9. The electrical connector of claim 1, wherein the plurality of signal terminals and the plurality of grounding terminals each extend in a mating direction, and sides of the at least one conductive plastic member that are parallel to the mating direction are entirely contained within the first or second-insulative body.

10. The electrical connector of claim 9, wherein the second insulative body is positioned opposite the third insulative body along a first direction, and sides of the at least one conductive plastic member that face in or opposite the first direction are entirely contained within the terminal subassembly.

11. The electrical connector of claim 10, wherein all sides of the at least one conductive plastic member are contained within the terminal subassembly.

12. The electrical connector of claim 4, wherein:

a first group of the plurality of extension parts of the at least one conductive plastic member extend towards the second insulative body;

a second group of the plurality of extension parts of the at least one conductive plastic member extend towards the third insulative body;

the first assembly space of the second insulative body comprises a plurality of openings each shaped to receive an extension part of the first group of the plurality of extension parts; and the second assembly space of the third insulative body comprises a plurality of openings each shaped to receive an extension part of the second group of the plurality of extension parts.

13. The electrical connector of claim 1, wherein the at least one conductive plastic member comprises:

a binder; and a plurality of conductive particles held within the binder.

14. The electrical connector of claim 1, wherein the at least one conductive plastic member comprises:

a plastic member comprising a plurality of surfaces; and a coating of conductive material on at least a portion of the plurality of surfaces.

15. The electrical connector of claim 1, wherein the at least one conductive plastic member has a bulk conductivity of between 10 Siemens/meter and about 200 Siemens/meter.

16. An electrical connector, comprising:

a first insulative body, comprising an accommodation space therein so as to provide a mating interface at a front side of the first insulative body;

a first terminal subassembly disposed within the first insulative body, the first terminal subassembly comprising:

a second insulative body and a third insulative body, wherein one side of the second insulative body is recessed with a first assembly space and a corresponding side of the third insulative body is recessed with a second assembly space;

a plurality of signal terminals fixed to the second insulative body with front ends thereof exposed within the accommodation space, and rear ends passing through the second insulative body and extending from a rear end of the first insulative body; and a plurality of grounding terminals fixed to the second insulative body with front ends thereof exposed within the accommodation space and rear ends passing through the second insulative body and extending from the rear end of the first insulative body; and a second terminal subassembly disposed within the first insulative body, the second terminal assembly comprising:

at least one conductive plastic member comprising a portion of the first terminal subassembly with at least a portion thereof exposed outside the first terminal subassembly;

wherein:

the at least one conductive plastic member comprises extension parts extending towards the plurality of grounding terminals and body portions between the extension parts set back from the plurality of signal terminals; and the at least one conductive plastic member is disposed between the first assembly space and the second assembly space.

17. The electrical connector of claim 1, wherein the plurality of extension parts extend in a protruding manner towards a corresponding grounding terminal of the plurality of grounding terminals and contact the corresponding grounding terminal.

18. The electrical connector of claim 17, wherein the first terminal subassembly conforms to the plurality of signal terminals and the plurality of grounding terminals.

19. The electrical connector of claim 18, wherein the first assembly space of the second insulative body and the second assembly space of the third insulative body conform to the at least one conductive plastic member.

20. The electrical connector of claim 18, wherein the at least one conductive plastic member is insert molded in at least one of the first assembly space of the second insulative body or the second assembly space of the third insulative body.

21. The electrical connector of claim 18, wherein the at least one conductive plastic member is inserted in and engaged with the second insulative body and the third insulative body.

22. The electrical connector of claim 18, wherein the at least one conductive plastic member comprises a first conductive plastic member disposed in the first assembly space and a second conductive plastic member disposed in the second assembly space such that the first and second conductive plastic members contact one another between the second insulative body and the third insulative body.

23. The electrical connector of claim 16, further comprising a metal casing, the first insulative body being disposed in the metal casing.

24. The electrical connector of claim 23, wherein the first insulative body conforms to the first terminal subassembly.

25. The electrical connector of claim 16, wherein the plurality of signal terminals and the plurality of grounding terminals extend in a mating direction, and a side of the at least one conductive plastic member facing opposite the mating direction is entirely exposed outside the terminal subassembly.

26. The electrical connector of claim 19, wherein:

a first group of the plurality of extension parts of the at least one conductive plastic member extend towards the second insulative body;

a second group of the plurality of extension parts of the at least one conductive plastic member extend towards the third insulative body;

the first assembly space of the second insulative body comprises a plurality of openings each shaped to receive an extension part of the first group of the plurality of extension parts; and the second assembly space of the third insulative body comprises a plurality of openings each shaped to receive an extension part of the second group of the plurality of extension parts.

27. The electrical connector of claim 16, wherein the at least one conductive plastic member comprises:

a binder; and a plurality of conductive particles held within the binder.

28. The electrical connector of claim 16, wherein the at least one conductive plastic member comprises:

a plastic member comprising a plurality of surfaces; and a coating of conductive material on at least a portion of the plurality of surfaces.

29. The electrical connector of claim 16, wherein the at least one conductive plastic member has a bulk conductivity of between 10 Siemens/meter and about 200 Siemens/meter.

30. A method of manufacturing an electrical connector, the method comprising:

forming a terminal subassembly by:

molding a first seat body over a first row of terminals, wherein the first seat body comprises at least one first assembly space adjacent a portion of the terminals in first row;

molding a second seat body over a second row of terminals, wherein the second seat body comprises at least one second assembly space adjacent a portion of the terminals in second row;

positioning a lossy member between the first seat body and the second seat body with extension portions within the at least one first assembly space and the at least one second assembly space; and inserting the terminal subassembly into a cavity of a housing comprising a slot configured to receive a mating component, with the first row of terminals aligned with a first side of the slot and the second row of terminals aligned with a second side of the slot.

* * * * *